United States Patent [19]

Donohue

[11] Patent Number: 4,457,814

[45] Date of Patent: Jul. 3, 1984

[54] PROCESS FOR ELECTROCHEMICAL REDUCTION OF TEREPHTHALIC ACID

[75] Inventor: John A. Donohue, Elmhurst, Ill.

[73] Assignee: Standard Oil Company (Indiana), Chicago, Ill.

[21] Appl. No.: 518,392

[22] Filed: Jul. 29, 1983

[51] Int. Cl.[3] ..... C25B 3/04

[52] U.S. Cl. ..... 204/75

[58] Field of Search ..... 204/75, 73 R, 59 R

[56] References Cited

U.S. PATENT DOCUMENTS 4,381,229 4/1983 Donohue ..... 204/75

4,402,805 9/1983 Donohue ..... 204/75

*Primary Examiner*—John F. Niebling

*Attorney, Agent, or Firm*—William C. Clarke; William T. McClain; William H. Magidson

[57] ABSTRACT

Terephthalic acid, as the sodium salt, is electrochemically reduced to sodium p-hydroxymethylbenzoate wherein the catholyte comprises a soluble sodium salt and pH of the catholyte is controlled within limits to obtain good circuit efficiency and little or no by-products.

21 Claims, 1 Drawing Figure

PROCESS FOR ELECTROCHEMICAL REDUCTION OF TEREPHTHALIC ACID

FIELD OF THE INVENTION

This invention relates to a process for electrochemical reduction of terephthalic acid, as the sodium salt, to sodium p-hydroxymethylbenzoate, and more particularly, to an improved process wherein the catholyte comprises a soluble sodium compound, and the pH of the catholyte is controlled within limits to obtain good current efficiency and little or no by-products, such as ring reduced compounds, coupled materials and amines.

BACKGROUND OF THE INVENTION

This invention relates to a process for electrochemical reduction of terephthalic acid, as the sodium salt, to the sodium salt of p-hydroxymethylbenzoic acid, and to improvements in product isolation and purification, wherein the catholyte comprises a soluble sodium compound, and the pH of the catholyte is controlled within limits to obtain good current efficiency and little or no by-products, such as ring-reduced compounds, coupled materials and amines.

Electrochemical reduction of the ammonium salt of terephthalic acid yields the ammonium salt of p-hydroxymethylbenzoic acid (p-HMBA). However, the ammonium salt of p-HMBA is difficult to purify because of the difficulty of crystallizing the ammonium salt without the inclusion of impurities in the ammonium crystals. The electrochemical reduction of terephthalic acid to p-hydroxymethylbenzoic acid in ammonia solution is taught in commonly-assigned applications Ser. No. 319,120 and Ser. No. 358,222, incorporated herein by reference, and in German Pat. No. 2,642,496.

Electrochemical reduction of the sodium salt of terephthalic acid yields the sodium salt of p-HMBA under controlled conditions. The sodium salt of p-HMBA, in the presence of water, forms a crystal with five molecules of water which crystallizes readily in a pure crystalline form which is easily separated from other impurities. However, usual electrochemical reduction of the sodium salt of terephthalic acid without control of pH results in ring reduction of the terephthalic acid with consequent yield losses.

This invention relates to p-hydroxymethylbenzoic acid. More particularly, it relates to a process for the preparation of p-hydroxymethylbenzoic acid with a low level of impurities. Even more particularly, the invention relates to a process for preparation of p-hydroxymethylbenzoic acid (p-HMBA) by electrochemical reduction of sodium terephthalate to produce the sodium salt of p-HMBA, wherein ring reduction of the terephthalic acid and production of by-products are minimal.

Numerous methods are known for the preparation of p-hydroxymethylbenzoic acid (p-HMBA). Some of these methods are based on the saponification of a corresponding halogenmethyl compound, such as p-chloromethylbenzoic acid, or the esters thereof, or p-chloromethylbenzonitrile. For example, several methods for the synthesis of p-hydroxymethylbenzoic acid are taught in U.S. Pat. No. 4,130,179, incorporated herein by reference.

p-Hydroxymethylbenzoic acid must be free from by-products when it is to be employed in polycondensation reactions, such as in the preparation of polyesters. However, most of the known processes for the preparation of p-hydroxymethylbenzoic acid do not yield the acid free from by-products. Thus, for example, during the saponification of highly pure p-chloromethylbenzoic acid in a faintly alkaline aqueous medium, up to 10% of dibenzylether-4,4'-dicarboxylic acid is always produced.

It is well-known that in the cathodic reduction of carboxylic acids that two types of products can result, either the corresponding aldehyde in a two-electron process or the hydroxymethyl compound in a four-electron process where the aldehyde is further reduced to the alcohol. (M. Baizer, *Organic Electrochemistry*, Dekker, N.Y. (1973), p. 414) The alcohol can be further reduced to the methyl group. Reduction of the benzene ring of aromatic dicarboxylic acids has also been observed to yield other impurities. (P. C. Condit, *I&EC*, 48(8), 1252(1956); U.S. Pat. Nos. 2,477,579; 2,477,580; 3,471,381; and 3,542,656.)

Accordingly, in the preparation of p-hydroxymethylbenzoic acid by whatever method used to obtain the crude acid, many by-products can also be produced, among which are 4-carboxybenzaldehyde, dihydroxymethylbenzene, toluic acid, coupled products and ring-reduced products. Hydrogenation of terephthalic acid in an electrochemical process results in quantities of 4-carboxybenzaldehyde despite the concurrent hydrogenation of 4-carboxybenzaldehyde to p-hydroxymethylbenzoic acid. 4-Carboxybenzaldehyde is a particularly undesirable impurity because it acts as a chain-stopper during polyesterification. 4-carboxybenzaldehyde is difficult to remove by physical means but it can be hydrogenated to the hydroxymethyl compound, i.e., p-hydroxymethylbenzoic acid, in an electrochemical process as is taught by Baizer, mentioned above. Toluic acid acts as a chain-stopper during polyesterification but toluic acid can be efficiently removed by cooling and crystallizing crude p-hydroxymethylbenzoic acids containing it. Ring-reduced by-products reduce current efficiency as measured in product yield.

Accordingly, under the usual conditions used to obtain reduction of terephthalic acid to p-hydroxymethylbenzoic acid, the presence of the resulting by-products in the product stream renders the resulting p-hydroxymethylbenzoic acid unfit for polyesterification without further extensive purification. Current efficiency also can be low. Methods of purification of p-hydroxymethylbenzoic acid are detailed in commonly assigned application Ser. No. 445,659, incorporated herein by reference.

In a typical purification of crude p-hydroxymethylbenzoic acid prepared electrochemically in aqueous ammonium solution, the first step is preferably hydrogenation of the 4-carboxybenzaldehyde to p-hydroxymethylbenzoic acid (p-HMBA). Any suitable catalyst, such as platinum or palladium, can be used. Noble metal catalysts, such as platinum on carbon, are preferred. Typical hydrogenation processes are taught in U.S. Pat. No. 3,726,915; German Offen. No. 2,045,747; Japanese Kokai Tokyo Koho No. 80,143,933; Belgium Pat. No. 876,860; German Offen. No. 2,709,525 and U.S. Pat. No. 4,260,817.

Another procedure is to distill off the water content of the hydrogenated ammonium salt of p-HMBA, then vacuum decompose the residue to drive off the ammonia of the salts of p-HMBA at temperatures of about 115° C. and a pressure of below 3 mm Hg. An alternative procedure is to vacuum steam decompose the ammonium salts of p-HMBA at about 200° C. and 0.2 mm Hg to obtain the free acid, p-HMBA, which contains impurities.

Treatment of the free acid by hot aqueous filtration removes terephthalic acid. The free acid obtained by decomposing the ammonium salt is dissolved in water and filtered at a temperature within the range of from about 80° C. to about 130° C., preferably from about 110° C. to about 120° C. under pressure of from about 15 to 50 psi. The terephthalic acid, being less soluble in hot water than p-hydroxymethylbenzoic acid, solubilizes to a limited amount and is removed by filtration.

p-Toluic acid contaminants can be removed from the free acid of p-HMBA obtained by the ammonium process by extraction with p-xylene from aqueous solutions. The extraction can be performed at temperatures within the range of from about 23° C. to about 175° C., preferably from about 23° C. to about 150° C.

The pure p-HMBA in aqueous solution after extraction of p-toluic acid is thereupon obtained by cooling and crystallization. The filtrate is recycled.

An alternative procedure to obtain the free acid from the crude ammonium salt of p-HMBA is acidification with a mineral acid. The free acid, p-HMBA, is dissolved in excess hot water. The slurry is filtered to remove terephthalic acid, the free terephthalic acid being less soluble in water of a temperature of 80° C. to 130° C. under pressure of from about 15 to 50 psi, preferably 110° C. to 120° C., than the free acid of p-HMBA. Cooling of the filtrate yields p-HMBA.

Crude p-HMBA from the ammonium process can also be purified by forming the acetate of the acid, followed by vacuum distillation, recrystallization of the acetate and hydrolysis, as is taught in commonly assigned U.S. Pat. No. 4,182,847.

Since the acid monomer, p-hydroxymethylbenzoic acid, can also be obtained by hydrolysis of the ester of the acid, the purified acid can also be obtained by purification of the ester prior to hydrolysis of the acid.

Purification of p-hydroxymethylbenzoic acid in the form of the sodium salt, as is taught in U.S. Pat. No. 3,534,089, incorporated herein by reference, provides an improved method which overcomes the disadvantages of the ammonium process wherein the ammonium salt is the product of the electrochemical reduction of terephthalic acid. However, simple replacement of the ammonium moiety by a sodium moiety after reduction of terephthalic acid in an ammonium solution is not economically feasible because of product losses due to formation of the disodium salt of unreacted terephthalic acid, which must be removed for recycle. As previously noted, extensive ring formation occurs if the sodium salt of p-HMBA is prepared by the electrochemical reduction of sodium terephthalate by previously known methods.

Accordingly, it is an object of the present invention to provide an electrochemical process for the reduction of terephthalic acid wherein the electrochemical product is the sodium salt of p-hydroxymethylbenzoic acid. A further object of this invention is to provide a process for electrochemical manufacture of p-hydroxymethylbenzoic acid from terephthalic acid wherein ring reduction does not occur or is significantly less than that obtained with the disodium salt of terephthalic acid, and the level of impurities after recrystallization is below 100 ppm of terephthalic acid. A still further object of this invention is to provide a process for the electrochemical reduction of terephthalic acid, and subsequent purification wherein the purification can be performed easily and simply using the sodium salt of p-HMBA. These and other objects of the present invention will become apparent to those skilled in the art from a reading of the following.

SUMMARY OF THE INVENTION

Terephthalic acid, as the sodium salt, is electrochemically reduced to the sodium salt of p-hydroxymethylbenzoic acid in a process in a two-compartment electrolysis cell with a suitable membrane in which (a) the cathode has a hydrogen overvoltage which is greater than the potential for the reduction of terephthalic acid to p-hydroxymethylbenzoic acid, (b) the reduction of terephthalic acid to p-hydroxymethylbenzoic acid is performed as the sodium salt, and (c) the pH of the catholyte is within the range of 6 to 11, preferably in the range of from about 8.0 to about 9.5. The electrolysis cell can be fed from a reservoir containing sodium terephthalate and recycle sodium salt of p-HMBA at a pH of 8.0 to 9.5. Pure p-HMBA is obtained by precipitation of the sodium salt of p-HMBA, filtration, recrystallization, acidification and recrystallization.

DETAILS OF THE INVENTION

The term "current efficiency" is defined as ratio of consumption in Faradays used to make product, to total Faradays used times 100. The term "amalgam" is defined as referring only to an alloy of mercury.

Figure 1:
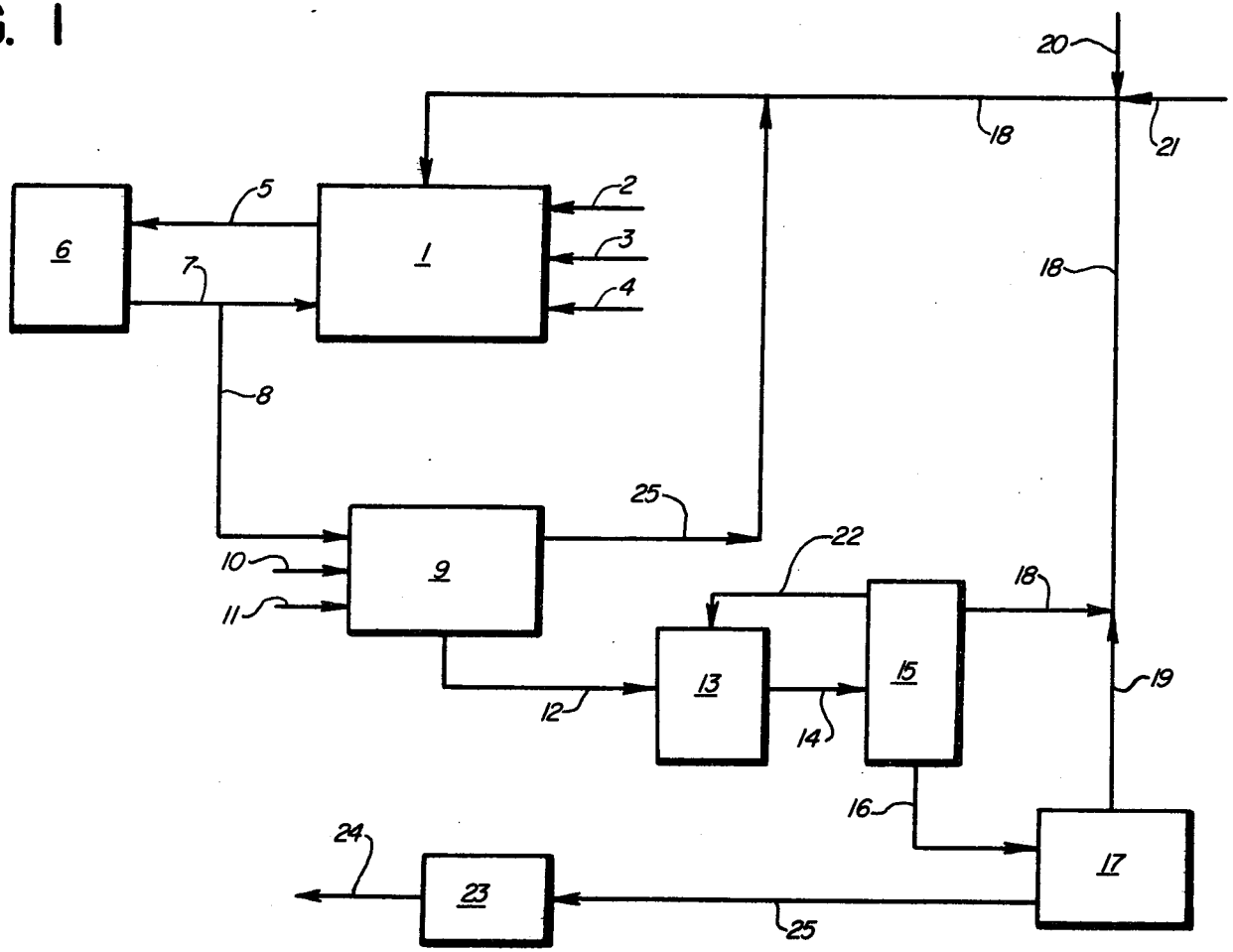
FIG. 1 is a schematic illustration of the invention according to which sodium terephthalate is electrochemically reduced to sodium p-hydroxymethylbenzoate, isolated, purified and then acidified and purified to obtain the final purified p-hydroxymethylbenzoic acid.

The present invention provides a process for the electrochemical preparation of sodium p-hydroxymethylbenzoate with high current efficiency and minimal production of by-product impurities. The process comprises performing the cathodic reduction to obtain the crude Na p-HMBA in an electrolysis cell having two compartments, a cathode compartment and an anode compartment. The anode and cathode compartments can be separated by a cation-exchange diaphragm, although the presence of a separating diaphragm is not an essential element of the invention. If a separating diaphragm is used, the cathode and anode and the separating diaphragm are preferably in parallel planes. Advantageously, several of the elementary electrolysis cells can be combined in the manner of a filter press.

In general, any metal with a higher hydrogen overvoltage than the potential for the reduction of terephthalic acid to p-hydroxymethylbenzoic acid is suitable for the cathode. Examples of materials forming the cathode are mercury, lead and amalgams, alloys of lead with cadmium, antimony, tin or bismuth, and amalgams of lead and lead alloys. An amalgam cathode is prepared by abraiding in a suitable manner the surface of the solid cathode to remove any metal oxidation and then contacting the abraided metallic surface with mercury to form the amalgam. In the case of lead, it is sufficient to abraid the surface of the lead solid to remove all forms of lead oxide and any other impurities. Liquid mercury of 99.9% purity is used as a bath for the abraided solid-lead cathode. In the case of lead, the lead amalgam is formed in the surface of the lead at room temperature upon contacting the mercury bath.

The anode of the electrolysis cell usually consists of a solid electrically-conducting material which is electrochemically stable in the anolyte and under the operating conditions considered. Examples of such materials are metals and metalloids, such as platinum, platinized titanium, graphite, lead and its alloys, particularly with silver, antimony or tin.

Optionally, any known cation-exchange membrane can be used to separate the catholyte from the anolyte, but membranes of the homogeneous type are preferred. These membranes optionally can be reinforced with a screen. For carrying out electrolysis operations over a long period, it is naturally preferred to use membranes which do not swell and which are stable to the action of the various constituents of the catholyte and the anolyte. Examples of such membranes are those of Nafion (trademark of E. I. du Pont de Nemours & Co.) perfluorosulfonic acid.

The catholyte can comprise a neutral solvent to which a sodium salt, such as sodium hydroxide, sodium acetate, sodium bicarbonate or sodium carbonate has been added, approximately 1:1 to 2:1 sodium mole per mole of terephthalic acid. Examples of neutral solvents are water, methanol and other alcohols mixed with water to obtain necessary solvent properties.

pH of the catholyte solution is within the range of from about 6.0 to 11.0, preferably within the range of from about 8.0 to about 9.5. Control of pH is obtained either by use of a buffering agent in the electrochemical reduction or by the formation of a monosodium monoammonium salt of terephthalic acid prior to the electrochemical reduction of salt of terephthalic acid. Any suitable buffering agent or solution which will maintain the catholyte solution of sodium terephthalate within the required pH range and which does not react detrimentally with the product of the electrochemical reduction can be used with the sodium salt of terephthalic acid. Boric acid can be used as a buffering agent with addition of sodium hydroxide.

Ammonium hydroxide and terephthalic acid can also be used to control the pH. The ammonium hydroxide can act as a buffering agent and also react with the terephthalic acid to form the monosodium monoammonium salt. The terephthalic acid can act as a buffering agent by reacting with the sodium ion present. Additional sodium hydroxide would also be required.

The mole ratio of sodium to terephthalic acid is approximately 1:1 when the buffer is ammonia. The mole ratio of sodium to terephthalic acid is approximately 2:1 when the buffer is boric acid or terephthalic acid. If boric acid is used as the buffer, mole ratio of sodium to terephthalic acid is 2:1 or higher. Additional sodium is required if boric acid is present.

Ammonium hydroxide is preferred. Boric acid and terephthalic acid as buffers have the advantage that amine impurities are not formed, as is possible with use of ammonium hydroxide, but ring reduction and coupling can occur, with consequent loss in yield.

Concentration of ammonia as ammonium hydroxide is within the range of from about 1 gram of ammonium hydroxide per 2 grams of terephthalic acid to about 1 gram of ammonium hydroxide per gram of terephthalic acid and wherein the pH of the resulting solution is at least 6.0, preferably from about greater than 7.0 to less than 11.0, more preferably within the range of from about 8.0 to about 9.5.

Formation of the monosodium monoammonium salt of terephthalic acid prior to the electrochemical reduction of the acid is also suitable. The addition of ammonium hydroxide, sodium hydroxide and terephthalic acid to the catholyte solution is controlled to cause the formation of the monosodium monoammonium salt of terephthalic acid. Sodium hydroxide is added to the catholyte solution in the ratio of one mole per mole of terephthalic acid. Then, sufficient ammonium hydroxide is used to form monosodium monoammonium terephthalate as a neutral salt, and additional ammonium hydroxide is added to maintain the pH preferably within the range of from about 6.0 to 11.0, more preferably from about 8.0 to about 9.5.

Control of pH is maintained preferably by means of a reservoir from which the catholyte solution of predetermined pH is constantly circulated to the electrolysis cell and returned, containing electrolysis products of sodium-p-hydroxymethylbenzoate and by-products.

Once pH equilibrium, approximately 7.0 pH, has been established in the reservoir by the addition of sodium hydroxide in the ratio of one mole per mole of terephthalic acid and the addition of sufficient ammonium hydroxide to react with the second carboxy group of the terephthalic acid, additional ammonium hydroxide is added to the reservoir to increase the pH to within the range of from about 7.5 to about 11.0, preferably from about 8.0 to about 9.5.

In operation, as the catholyte solution is withdrawn from the reservoir to undergo electrolysis, additional sodium ammonium terephthalate is added to the reservoir via a process recycle stream to which additional terephthalic acid, ammonium hydroxide and disodium terephthalate have been added, thus maintaining a make-up condition for removal of the sodium ammonium terephthalate to the electrolysis cell from the reservoir.

In a suitable method of operation, in presence of a buffer, the catholyte consists of a solvent, preferably water, terephthalic acid, sodium hydroxide, and sodium terephthalate with a soluble buffer. The pH of the resulting solution is at least 6.0, preferably with a pH within the range of from about 8.0 to about 9.5. The concentrations of sodium terephthalate and sodium salt can be either constant, when the reaction is carried out continuously, or variable when the reaction is carried out discontinuously. The concentration of sodium terephthalate in most cases is less than the saturation concentration at the temperature of electrolysis; generally, this concentration is greater than 2% by weight, and preferably greater than 3% when the current density is high, these values relating particularly to the constant concentration when the reaction is carried out continuously and to the final concentration when the reaction is carried out discontinuously.

The catholyte can also contain reaction by-products in small amounts, e.g., generally less than 1% by weight.

An aqueous acid solution can be used as the anolyte, as well as basic solutions with NaOH or neutral solutions with $Na_2SO_4$, or any other anolyte capable of providing electrical conductivity between the two electrodes can be used. Aqueous solutions of sulphuric or phosphoric acids are usually employed in a concentration generally of 0.1 to 5 moles/liter, and preferably 0.5 to 2 moles/liter.

The current density at the cathode is preferably 1 to 200 amperes per decimeter squared ($A/dm^2$), especially preferable from about 85 to about 100 $A/dm^2$.

The flow of the catholyte in a closed circuit is usually achieved by means of a pump. The circuit can, in addition, contain attached devices such as a heat exchanger or an expansion vessel. The expansion vessel enables control of liquid levels of the catholyte and also permits the catholyte to be withdrawn if necessary. By-product hydrogen can also be removed.

The anolyte can also be circulated, preferably in an anolyte circuit similar to that of the catholyte, so that the pressure on either side of the separating diaphragm can be substantially the same.

At least one spacer is preferably present in the anode and cathode compartments; these spacers serve to prevent deformations of the cation-exchange membrane and prevent contact between this membrane and the electrodes. These spacers also help to render uniform the spacing between the membrane and electrodes which contain the electrolyte and to increase turbulence at the electrode surface. These spacers are generally manufactured from synthetic polymers which are chemically inert and which do not conduct electricity; they can be made in the form of interlaced, intertwined, knotted or welded yarns (e.g., woven fabrics, grids or nets) or they can be in the form of plates possessing holes or grooves. In practice, these spacers are oriented along planes which are parallel to those of the electrodes and the separating diaphragm.

Sodium ammonium terephthalate or sodium terephthalate conversion can be monitored to obtain 100% conversion, but less than 100% conversion can be preferable because of the undesirable by-products. Impurities such as dihydroxymethylbenzene and sodium toluate can result at high terephthalate conversion of 95–96% or more. Percent conversion is balanced to obtain maximum conversion to sodium p-hydroxymethylbenzoate and minimum conversion to undesirable by-products.

After an initial period of operation, additional sodium salt of terephthalic acid is added to maintain a basic condition sufficient to cause additions of terephthalic acid to dissolve, with a pH above 6.0 and preferably with a pH within the range of 8.0 to about 9.5, to ensure solubility of the terephthalic acid.

At the end of electrolysis, the sodium p-hydroxymethylbenzoate can be isolated from the catholyte by salting out with disodium terephthalate and chilling. The unreacted disodium terephthalate is recovered and recycled.

The sodium p-hydroxymethylbenzoate is isolated from the electrolyte by the difference in water solubility between that of sodium terephthalate and sodium p-hydroxymethylbenzoate. The sodium p-hydroxymethylbenzoate is obtained by cooling the mother liquor, optionally after concentrating under reduced pressure. The cooling is carried out at temperatures below 40° C. and preferably below 25° C., the degree of concentration and the cooling temperature naturally vary according to the degree of purity desired for the p-hydroxymethylbenzoic acid.

The process of the invention possesses numerous advantages. Because the sodium salt is more soluble than the acid, the presence of the sodium salt helps prevent membrane plugging in the electrolysis cell and increased selectivity to sodium p-hydroxymethylbenzoate is obtained. The process makes it possible to use catholyte solutions which facilitate work-up and recovery of the sodium p-hydroxymethylbenzoate since the possibility of by-products of nitrogen compounds is less. The process allows electrolysis cells to be produced which are compact and easy to dismantle; and allows gases to be removed easily which are produced at the anode, especially oxygen, and which are capable of causing high resistance between the electrodes due to gas bubbles. It makes it possible to use high-current densities and to achieve easily the supply of electricity in series between the various elementary electrolysis cells in an assembly of several cells. It makes it possible to use cells with vertical electrodes. Finally, due to the constant geometrical shape of the preferred electrolysis cells, the anolyte and the catholyte can be circulated very rapidly, enabling lower concentrations of terephthalic acid to be employed and, as a result, better degrees of conversion in continuous operation to be obtained.

FIG. 1 is a diagram of the invented process using sodium hydroxide and ammonium hydroxide. Terephthalic acid, sodium hydroxide and ammonium hydroxide are metered into reservoir 1 by lines 2, 3 and 4 in ratios of one mole per mole at the beginning of the electrochemical reduction process to form sodium ammonium terephthalate. Added ammonium hydroxide is used as a buffer to raise the pH from approximately 7 to within the range of from about 8.0 to about 11.0. The sodium ammonium salt solution is thereupon pumped by suitable means by line 5 to electrolysis cell 6 wherein the salt of terephthalic acid is reduced to sodium p-hydroxymethylbenzoate (Na p-HMB). The Na p-HMB is thereupon pumped by line 7 back to the reservoir 1 which contains Na p-HMB, $NH_4OH$, and monosodium terephthalate. After optimum levels of Na p-HMB have been reached in the reservoir 1, a portion of the electrolysis cell output of line 7 is pumped by line 8 to reactor 9 to which make-up terephthalic acid and make-up sodium hydroxide are added by lines 10 and 11. Make-up terephthalic acid and sodium hydroxide are required because of the reduction of the sodium ammonium terephthalate to Na p-HMB and to salt out the Na p-HMB. Recycle ammonium salt from reactor 9 is pumped by line 25 to line 18 and thence to reservoir 1. The disodium terephthalate in reactor 9 is pumped with the solution removed from reservoir 1 by line 12 to chill unit 13 wherein the Na p-HMB is salted out by the presence of the disodium terephthalate. The resulting slurry in chill unit 13 is pumped by line 14 to filter 15 wherein solids comprising Na p-HMB are filtered and forwarded by line 16 to be recrystallized in crystallizer 17. Mother liquor from filter 15 is recycled to reservoir 1 by line 18. Mother liquor after dewatering from crystallizer 17 is recycled to reservoir 1 by line 19, which joins line 18. Recycle slurry from filter 15 is returned to chill unit 13 by line 22 if recycle is necessary to obtain sufficient cooling. Make-up terephthalic acid and ammonium hydroxide are added to line 18 by lines 20 and 21 to restore the sodium:ammonium:terephthalate ratio and are reacted in reservoir 1. Sodium p-hydroxymethylbenzoate is removed from crystallizer 17 by line 25 to reactor 23 where it is acidified to obtain p-hydroxymethylbenzoic acid.

The following examples illustrate the invention. The current efficiencies indicated are current efficiencies of p-hydroxymethylbenzoic acid relative to amount of current passed.

EXAMPLE I

Batch reduction of terephthalic acid to sodium p-hydroxymethylbenzoate was carried out in an electrolysis cell in the following manner. The cell was a 600-ml glass beaker fitted with a stopper of fluorocarbon rubber. Holes through the stopper gave entrance to a thermometer, and in some runs, a pH probe, and also the anolyte chamber. The anode support was a glass anolyte tube which was fitted with a fluorocarbon plastic holder to support the anode and a semi-permeable membrane. The anode was a circular platinum screen about one inch in diameter. The membrane was of sulfonated fluorocarbon polymer. The glass tube served as the anolyte chamber. The fluorocarbon plastic holder was inclined at an angle from the horizontal to permit gases rising from the cathode to escape. The cathode was of electrolytically pure mercury of 99.9% purity. A magnetic stirring bar was placed on top of the cathode mercury pool in the bottom of the glass beaker which served as the electrolysis cell.

In operation, the catholyte solution was placed in the cell with the cathode and with the stirring bar in place. The anode was inserted in the anolyte chamber, the chamber was filled with anolyte and inserted in the fluorocarbon stopper. The anolyte chamber was thereupon checked for membrane leakage and placed on the cell. The thermometers were inserted in the fluorocarbon stopper and the cell was assembled. The reaction was started at room temperature and reached operating temperature without direct heating.

Current density was controlled so as to maintain consumption of electricity slightly below the calculated quantity of 4 Faradays required for one equivalent weight of terephthalic acid.

An aqueous solution of 2 (wt)% sodium sulfate, approximately 0.14 moles/liter of water, was used as the pH neutral anolyte. The catholyte consisted of water, terephthalic acid, and sodium hydroxide. The cathode was mercury. The terephthalic acid reacted with the sodium hydroxide to form disodium terephthalate. The pH at the beginning of the electrochemical reaction was 7.2. As the reaction progressed, the pH increased to 12.9 at the end of the electrolysis. No attempt was made to maintain a neutral pH. Results are in Table I.

TABLE I

Electrochemical Reduction of Disodium Terephthalate-Mercury Cathode

| Run No. 7866 | pH | Current Density A/dm$^2$ | % Current Efficiency Na p-HMB | 2,5-DHT | DCHB |
|---|---|---|---|---|---|
| 116 | 7.2–12.9 | 2.5–5 | 6 | 80 | — |

2,5-DHT is disodium 2,5-dihydroterephthalate, a ring-reduced compound. DCHB is 4,4'-dicarboxyhydrobenzoin, which resulted by the coupling of 4-CBA.

The above results indicate that a ring-reduced compound is the predominant product obtained by electrochemical reduction of terephthalic acid in a neutral to highly basic catholyte wherein the terephthalic acid is present as the sodium salt and pH is not controlled.

EXAMPLE II

In the procedure of Example I, an aqueous solution of terephthalic acid was electrochemically reduced as the sodium salt. Additional terephthalic acid was added in the form of a slurry during the process of the reaction to control the pH to about 6.5. Process conditions were the same as Example I except that the anolyte was 1.0N NaOH, approximately 1.0 mole/liter of water. Results are in Table II.

TABLE II

Electrochemical Reduction of Disodium Terephthalate-Mercury Cathode

| Run No. 7866 | pH | Current Density A/dm$^2$ | % Current Efficiency Na p-HMB | 2,5-DHT | DCHB |
|---|---|---|---|---|---|
| 118 | 6.5 | 5 | 33 | 3 | 6 |

The above results indicate that production of the ring-reduced compound, 2,5-DHTA, is minimized with pH control of the catholyte in the range of about 6.5 but, Na p-HMB current efficiency is uneconomic presumably due to hydrogen formation caused by low pH.

EXAMPLE III

The procedure of Example II was repeated. Additional terephthalic acid was dissolved in the clear solution to prevent the pH from exceeding 11.0. Hydrogen formation was still substantial and total current efficiency was low. This may be due to the reaction of free terephthalic acid with sodium amalgam to make $H_2$ and disodium terephthalate. Results are in Table III.

TABLE III

Electrochemical Reduction of Disodium Terephthalate-Mercury Cathode and Added Terephthalic Acid

| Run No. 7866 | pH | Current Density A/dm$^2$ | % Current Efficiency Na p-HMB | 2,5-DHT | DCHB |
|---|---|---|---|---|---|
| 122 | 10.7–11.0 | 5 | 30 | 17 | 1 |

EXAMPLE IV

The above procedure of Example II was repeated but with a lead cathode instead of a mercury cathode. The pH was maintained at a level of 10.8 to 11.2 by addition of terephthalic acid. Results were:

TABLE IV

Electrochemical Reduction of Disodium Terephthalate-Lead Cathode

| Run No. 7866 | pH | Current Density A/dm$^2$ | % Current Efficiency Na p-HMB | 2,5-DHT | DCHB |
|---|---|---|---|---|---|
| 135 | 10.8–11.2 | 5 | 1 | 71 | — |

The lead cathode also caused high production of the ring-reduced compound, 2,5-DHT, at a pH of 10.8 to 11.2.

EXAMPLE V

The procedure of Example II was repeated with use of a soluble buffer to maintain the pH. The buffer used was boric acid. Additional terephthalic acid was added as the reaction proceeded to control pH within the range indicated. Current density was varied from 2.5 to 10.0 A/dm$^2$. pH was varied within the range of from 8.5 to about 11.0. Results are in Table V.

TABLE V

Electrochemical Reduction of Disodium Terephthalate-Mercury Cathode, Boric Acid Buffer and Terephthalic Acid

| Run No. 7866 | pH | Current Density A/dm$^2$ | % Current Efficiency Na p-HMB | 2,5-DHT | DCHB |
|---|---|---|---|---|---|
| 130 | 8.5–9.1 | 2.5 | 72 | N.A. | 11 |
| 132 | 8.5–9.1 | 5 | 66 | 3 | 14 |

TABLE V-continued

Electrochemical Reduction of Disodium Terephthalate-Mercury Cathode, Boric Acid Buffer and Terephthalic Acid

| Run No. 7866 | pH | Current Density A/dm² | % Current Efficiency Na p-HMB | 2,5-DHT | DCHB |
|---|---|---|---|---|---|
| 124 | 8–9 | 5 | 62 | 5 | 14 |
| 120 | 9–10 | 5 | 70 | 4 | 13 |
| 128 | 10–11 | 5 | 43 | 5 | 6 |
| 131 | 8.5–9.1 | 10 | 43 | 1 | 12 |

N.A. - Not Analyzed

The above data indicate highest Na p-HMB current efficiency is obtained when current density is less than 5 and pH is less than 9.1.

EXAMPLE VI

The procedure of Example V was repeated using a lead cathode. Current efficiency relative to Na p-HMB diminished, relative to similar runs, in Example V, Runs Nos. 7866-132 and 7866-124. Results are in Table VI.

TABLE VI

Electrochemical Reduction of Disodium Terephthalate-Lead Cathode

| Run No. 7866 | pH | Current Density A/dm² | % Current Efficiency Na p-HMB | 2,5-DHTA | DCHB |
|---|---|---|---|---|---|
| 133 | 8.6–8.9 | 5 | 38 | >1 | 6 |

The above data indicate a lead cathode is not as efficient as a mercury cathode, as in Table V.

EXAMPLE VII

The procedure of Example VI was repeated with a lead amalgam cathode. Results are in Table VII.

TABLE VII

Electrochemical Reduction of Disodium Terephthalate-Lead Amalgam Cathode

| Run No. 7866 | pH | Current Density A/dm² | % Current Efficiency Na p-HMB | 2,5-DHT | DCHB |
|---|---|---|---|---|---|
| 134 | 8.6–9.0 | 5 | 61 | 2 | 12 |

The above results indicate use of a lead amalgam cathode gives improved percent current efficiency over the current efficiency obtained with a lead cathode and approximately equivalent to that obtained with a mercury cathode.

EXAMPLE VIII

In the procedure of Example I, terephthalic acid was reduced to sodium p-hydroxymethylbenzoate in an electrolysis cell using a mercury cathode, platinum anode and Nafion membrane. Temperatures were in the range of 40°–50° C., pH range was 8.0–9.2 and current density was controlled to obtain a maximum rate of reduction without exceeding 50° C. The catholyte solution comprised 100 ml water, 8.7 g terephthalic acid, 2.7 ml 50% NaOH solution and sufficient ammonium hydroxide to obtain a pH of 8.0. Catholyte final volume was 108 ml. Anolyte was 2 (wt)% sulfuric acid. Results are in Table VIII.

TABLE VIII

Electrolysis of Sodium Terephthalate NaOH—$NH_4OH$ Catholyte

| Run 6852-63 | |
|---|---|
| Current Density, A/dm² | 0.5–1.7* |
| Hours of Run | 6 |
| Analysis of Catholyte (mg/ml) | 33 |
| As p-HMBA | |
| Terephthalic Acid | 37 |
| % Current Efficiency | 81–88 |
| Na p-HMB | |

*Current density was low because of acidic anolyte.

The above data indicate the improved Na p-HMB current efficiency obtained with a pH in the range of about 8.0 to about 9.2, a sodium hydroxide/ammonium hydroxide catholyte, a low current density and a mercury cathode.

The electrolysis of the terephthalic acid according to foregoing procedure was continued for an additional two days. Catholyte additions of terephthalic acid, sodium hydroxide and ammonium hydroxide were made periodically. Analyses of the catholyte for presence of sodium p-hydroxymethylbenzoate (Na p-HMB) and sodium terephthalate were made daily. Operating procedure and results are in Table IX.

The data in Table IX indicate that three days of electrolysis were required to obtain a Na p-HMB concentration sufficiently high enough to precipitate as Na p-HMB.$5H_2O$. Concentration of Na p-HMB of at least 115 mg as the free acid/ml of electrolyte is required to precipitate any Na p-HMB.$5H_2O$ at 24° C. At 0° C., precipitation of Na p-HMB.$5H_2O$ occurs at a concentration of 53 mg/ml. In both cases the solution is also saturated with disodium terephthalate.

TABLE IX

Extended Electrolysis of Sodium Terephthalate NaOH—$NH_4OH$ Catholyte - 4 Days

| | Day | Hrs. | Electrolyte Analysis (d) mg/ml p-HMBA | TA | Current Efficiency Na p-HMB |
|---|---|---|---|---|---|
| Run No. 6852-63 | 1 | 6 | 33 | 37 | 81–88 |
| Run No. 6852-67* | | | | | |
| (a) | 2 | 7 | 91 | 49 | |
| (b) | 3 | 7 | 148 | 37 | |
| (c) | 3 | | 147 | 101 | |
| Solids Filtered at 24° C. | 4 | 0 | (~0.7 g Na p-HMB.$5H_2O$ ppt) | | |
| Solids Filtered at 3° C. | 4 | 0 | (~21.0 g Na p-HMB.$5H_2O$ ppt) | | |
| Filtered Catholyte | | | 75 | 116 | |

Notes: Additions were
(a) 13.3 g TA, 3.6 ml 50% NaOH, 6 ml $NH_4OH$
(b) 16 g TA, 3.6 ml 50% NaOH, 4 ml $NH_4OH$
(c) 9.3 g TA, 5.5 g NaOH
(d) Electrolyte analyses were made of the free acids as p-HMBA and as TA
*Current was continually raised to get maximum rate without exceeding 50° C.

The data in Table IX relates to the flow diagram in FIG. 1 as follows. Three days of electrolysis were necessary to reach a concentration of 15–20 (wt) % p-HMBA in reservoir 1. During this period additions (a) and (b) were made via lines 2, 3 and 4. Because this was a batch run the entire catholyte at the end of day 3 was treated in reactor 9 with addition (c) by lines 10 and 11. The resulting solution was allowed to cool in chill unit 13 (to 24° C.) overnight to recover (0.7 g) of crude Na p-HMB.$5H_2O$ by filter 15. Additional cooling in chill unit 13 of recycled material by line 22 to 3° C. resulted in a 21 g yield of crude Na p-HMB.5$H_2O$. The filtered catholyte, which now had given up approximately half its Na p-HMB was treated with terephthalic acid and $NH_4OH$ by lines 20 and 21 to convert disodium terephthalate back to sodium, ammonium terephthalate. The resulting slurry was electrolyzed for several more days and worked up similarly to demonstrate the recycle process.

What is claimed is:

1. A process for the preparation of p-hydroxymethylbenzoic acid by electrochemical conversion of terephthalic acid wherein improved current efficiency is obtained and production of by-product impurities is decreased to low levels which comprises electrochemical reduction of terephthalic acid as a sodium salt in a two-compartment electrolysis cell with a suitable membrane wherein (a) the cathode has a hydrogen overvoltage which is greater than the potential for reduction of terephthalic acid to p-hydroxymethylbenzoic acid, (b) pH of the catholyte solution is within the range of from about 6 to about 11, (c) said catholyte comprises a solvent, a solution of terephthalic acid and a soluble sodium salt wherein the ratio of moles of sodium to moles of terephthalic acid is from about 1:1 to about 2:1, and (d) said electrochemical reduction is in the presence of a soluble buffer.

2. The process of claim 1 wherein (a) said two compartments of said cell are separated by a cation exchange membrane (b) current density at the cathode is within the range of 1 to 200 $A^2/dm$, and (c) the soluble sodium salt is selected from the group consisting of sodium hydroxide, sodium acetate, sodium carbonate and sodium bicarbonate.

3. The process of claim 1 wherein said solvent is water.

4. The process of claim 1 wherein said soluble sodium salt is sodium hydroxide.

5. The process of claim 1 wherein said buffer is selected from the group consisting of ammonia, boric acid and terephthalic acid.

6. The process of claim 5 wherein said buffer is ammonia and said mole ratio of sodium to terephthalic acid is 1:1.

7. The process of claim 5 wherein said buffer is selected from the group consisting of boric acid and terephthalic acid and the mole ratio of sodium to terephthalic acid is at least 2:1.

8. The process of claim 2 wherein said cation exchange diaphragm is of the homogeneous type.

9. The process of claim 8 wherein said diaphragm is a membrane of perfluorosulfonic acid.

10. The process of claim 1 wherein concentration of said terephthalic acid is greater than 2% by weight of the total solution.

11. The process of claim 6 wherein concentration of said ammonia as ammonium hydroxide is within the range of from about 1 gram of ammonium hydroxide per 2 grams of terephthalic acid to about 1 gram of ammonium hydroxide per gram of terephthalic acid and wherein the pH of the resulting solution is within the range of from about 6.0 to about 11.0.

12. The process of claim 11 wherein said pH of resulting solution is from about greater than 7.0 to less than 11.0.

13. The process of claim 11 wherein said pH of resulting solution is within the range of from about 8.0 to about 9.5.

14. The process of claim 2 wherein current density is within the range of from about 85 to about 100 $A/dm^2$.

15. The process of claim 1 wherein terephthalic acid conversion to p-hydroxymethylbenzoic acid is less than 100%.

16. The process of claim 1 wherein said terephthalic acid conversion to p-hydroxymethylbenzoic acid is less than 96%.

17. The process of claim 1 wherein the cathode is metal and is selected from the group consisting of mercury, lead, alloys of lead with metals selected from the group consisting of cadmium, antimony, tin, and bismuth; and amalgams of lead and lead alloys.

18. The process of claim 17 wherein said metal of said cathode is lead, and surface of said cathode is lead amalgam.

19. The process of claim 1 wherein said sodium p-hydroxymethylbenzoate is isolated from the catholyte by salting out with disodium terephthalate and chilling.

20. The process of claim 1 wherein said process is continuous process.

21. The process of claim 1 wherein unreacted sodium salt of terephthalic acid is recovered and recycled.

* * * * *